US012728336B2

(12) United States Patent
Brutus et al.

(10) Patent No.: US 12,728,336 B2
(45) Date of Patent: Sep. 8, 2026

(54) FENCING SWORD COVER SYSTEM

(71) Applicants: Joy Charisse Brutus, Flossmoor, IL (US); Caleb Phillippe Brutus, Flossmoor, IL (US); Phillippe Andre Brutus, Flossmoor, IL (US)

(72) Inventors: Joy Charisse Brutus, Flossmoor, IL (US); Caleb Phillippe Brutus, Flossmoor, IL (US); Phillippe Andre Brutus, Flossmoor, IL (US)

( * ) Notice: Subject to any disclaimer, the term of this patent is extended or adjusted under 35 U.S.C. 154(b) by 349 days.

(21) Appl. No.: 18/478,738

(22) Filed: Sep. 29, 2023

(65) Prior Publication Data

US 2025/0108281 A1 Apr. 3, 2025

(51) Int. Cl.
*A63B 69/02* (2006.01)

(52) U.S. Cl.
CPC ..... *A63B 69/02* (2013.01)

(58) Field of Classification Search
CPC ..... A63B 69/02
USPC ..... D21/508; D22/118; 30/295; 224/432; 42/53; 463/47.1
See application file for complete search history.

(56) References Cited

U.S. PATENT DOCUMENTS

| | | | | |
|---|---|---|---|---|
| 37,222 A | | 12/1862 | Ernst | |
| 2,998,974 A | * | 9/1961 | Stafford | A63B 69/02 273/440.1 |
| 3,516,662 A | * | 6/1970 | Kuenstler, Jr. | A63B 69/02 463/47.1 |
| 5,009,348 A | | 4/1991 | Derkatz | |
| 5,115,953 A | | 5/1992 | Werner | |
| 5,511,311 A | | 4/1996 | Collins | |
| 6,036,602 A | * | 3/2000 | Abbott | F41B 15/02 463/47.7 |
| 6,497,619 B2 | * | 12/2002 | Dowdy | A63H 33/009 434/11 |

(Continued)

FOREIGN PATENT DOCUMENTS

| | | | | |
|---|---|---|---|---|
| CN | 111319068 B | | 6/2020 | |
| EP | 2 450 163 A1 | | 5/2012 | |
| WO | WO-2022181506 A1 | * | 9/2022 | A63H 33/009 |

OTHER PUBLICATIONS

"Director's Showcase (DSI) Color Guard Sabre Hilt Guard," Amazon, retrieved from https://www.amazon.com/Color-Guard-Directors-Showcase-DSI/dp/B01EX5O7FG/ on Feb. 17, 2023, 6 pages.

(Continued)

*Primary Examiner* — Omar Flores Sanchez
(74) *Attorney, Agent, or Firm* — Foley & Lardner LLP

(57) ABSTRACT

A fencing sword cover system includes a sheath, a guard cover, and/or one or more emblems. The sheath may be configured to surround at least a portion of a blade of a fencing sword. The guard cover may include a sheath coupling, a connecting wall, and a guard coupling. The sheath coupling may be coupled to the sheath. The connecting wall may be contiguous with the sheath coupling. The connecting wall may include one or more input receptors. The guard coupling may be coupled to a guard of the fencing sword. The guard coupling may be contiguous with the connecting wall and separated from the sheath coupling by the connecting wall. The one or more emblems may include respective adaptors. The adaptors may be configured to be selectively coupled to the one or more input receptors.

20 Claims, 8 Drawing Sheets

(56) References Cited

U.S. PATENT DOCUMENTS

| | | | | |
|---|---|---|---|---|
| 7,278,898 | B2 | 10/2007 | Kim et al. | |
| 7,473,157 | B2 * | 1/2009 | Reinhardt | A63H 33/009 434/11 |
| 7,658,664 | B2 * | 2/2010 | Tong | A63H 33/009 482/13 |
| 7,833,130 | B1 * | 11/2010 | Horvath | A63B 71/06 482/84 |
| 8,998,674 | B2 * | 4/2015 | Richins | A63H 33/009 446/473 |
| 9,481,099 | B2 | 11/2016 | Gingrich | |
| 2002/0133952 | A1 | 9/2002 | Kenny | |
| 2015/0148139 | A1 * | 5/2015 | Morehouse | A63B 71/0605 463/47.1 |
| 2015/0190938 | A1 | 7/2015 | Kommer | |
| 2016/0146451 | A1 | 5/2016 | Hsieh | |
| 2017/0246752 | A1 | 8/2017 | Heine et al. | |
| 2017/0355057 | A1 | 12/2017 | Owens | |
| 2019/0351570 | A1 | 11/2019 | Siffermann | |

OTHER PUBLICATIONS

"Leonark Fencing Sword Sling Shoulder Bag for Foil Epee and Saber—Hema Longsword Bag Cover Case for Fencing Weapon," Amazon, retrieved from https://www.amazon.com/LEONARK-Fencing-Sword-Foil-Saber/dp/B07BYYFY4X?ref_=ast_sto_dp&th=1 on Feb. 17, 2023, 10 pages.

"Silicone Hot Handle Holder,6PCS Pan Handle Sleeve Pot Holders Cover Green, Non Slip Rubber Pot Holders for Kitchen Heat Resistant, Handles Grip Covers for Cast Iron Skillets Frying Pans Casserole," Amazon, retrieved from https://www.amazon.com/Silicone-Holders-Resistant-Skillets-Casserole/dp/B0BR9Z9FCZ/ on Feb. 17, 2023, 8 pages.

Blue Gauntlet, BG 3-wpn Universal Hard Cover, https://www.blue-gauntlet.com/BG-3-wpn-universal-Hard-Cover-_p_3710.html, accessed Feb. 20, 2023.

Crocs, "Crocs x Dreamville 13-Pack Jibbitz Shoe Charms," Amazon, retrieved from https://www.amazon.com/Crocs-Dreamville-13-Pack-Jibbitz-Charms/dp/B0BHF23W31/ref=sr_1_1?keywords=dreamvillejibbitz&qid=1681147083&sprefix=dreamville%2Caps%2C136&sr=8-1 on Apr. 11, 2023, 9 pages.

Ergo Chef, "Assorted Knife Edge Guards," retrieved from https://ergochef.com/product/assorted-knife-edge-guards/ on Feb. 17, 2023, 9 pages.

Grainger, "VOLLRATH Silicone Grips: Fits 8 and 10 in Pans, 5 in Overall Lg, Silicone," retrieved from https://www.grainger.com/product/6PVC6?gucid=N:N:PS:Paid:GGL:CSM-2295:4P7A1P:20501231&gclid=EAIaIQobChMI9JOzmemf_glVwidMCh2coA3CEAQYASABEglxlvD_BwE&gclsrc=aw.ds on Apr. 11, 2023, 2 pages.

Imex Sport, Sheaths, 2021, https://imexsport.ca/en/bags/sheats.html, accessed Feb. 20, 2023.

Knives and Tools, Sheath Materials for Fixed Knives, Sep. 6, 2018, https://www.knivesandtools.com/en/ct/sheath-materials-for-fixed-knives.htm, accessed Feb. 20, 2023.

Leon Paul, Blade Covers, 2022, https://www.leonpaul.com/fencing-weapons/fencing-blades-foil-epee-sabre/blade-covers.html, accessed Feb. 20, 2023.

The Knife Collection, "TKC Ontario ESEE 3 / RAT 3 Kydex Sheath," retrieved from https://theknifeconnection.com/tkc-ontario-esee-3-rat-3-kydex-sheath-od-olive-drab-green/ on Feb. 17, 2023, 4 pages.

* cited by examiner

300

FENCING SWORD COVER SYSTEM

FIELD

The present application generally relates to a fencing sword cover system.

BACKGROUND

Swords, such as fencing swords, may be constructed from a steel material. For example, fencing swords are often made with a low-carbon steel composition that allows for a balance between flexibility and rigidity. Athletes may travel with one or more fencing swords between bouts. The variable environments found while traveling may cause harm to the blade of a fencing sword. Additionally, while in use during bouts or practice, the blade can come into contact with sweat and/or humidity in the atmosphere, which may also cause harm to the blade.

SUMMARY

At least one aspect is directed to a fencing sword cover system. The fencing sword cover system can include a sheath configured to surround at least a portion of a blade of a fencing sword and a guard cover. The guard cover can include a sheath coupling coupled to the sheath, a connecting wall contiguous with the sheath coupling, the connecting wall comprising a first input receptor, and a guard coupling coupled to a guard of the fencing sword, the guard coupling contiguous with the connecting wall and separated from the sheath coupling by the connecting wall. The fencing sword cover system can include a first emblem comprising a first adaptor, the first adaptor configured to be selectively coupled to the first input receptor. The fencing sword cover system can include a first guard clasp disposed on a first distal portion of the guard coupling and a second guard clasp disposed on a second distal portion of the guard coupling.

At least one aspect is directed to a method for covering a fencing sword by a fencing sword covering system. The method can include surrounding at least a portion of a blade of the fencing sword with a sheath of the fencing sword cover system. The method can include coupling a guard cover of the fencing sword cover system to the fencing sword by coupling a guard coupling to a guard of the fencing sword, wherein the guard cover includes a sheath coupling coupled to the sheath, a connecting wall contiguous with the sheath coupling, the connecting wall comprising a first input receptor, and the guard coupling, the guard coupling contiguous with the connecting wall and separated from the sheath coupling by the connecting wall. The method can include selectively coupling a first adaptor of a first emblem to the first input receptor. The method can include coupling a first guard clasp disposed on a first distal portion of the guard coupling to a second guard clasp disposed on a second distal portion of the guard coupling, the first distal portion and the second distal portion disposed around the guard of the fencing sword.

At least one aspect is directed to a method for covering a fencing sword by a fencing sword covering system. The method can include surrounding at least a portion of a blade of a fencing sword with a sheath. The method can include fastening a guard cover to a guard of the fencing sword, the guard cover selectively coupled to the sheath and comprising a connecting wall. The method can include installing a first adaptor of a first emblem into a first input receptor of the connecting wall. The method can include removing the first adaptor from the first input receptor. The method can include installing the first adaptor into a second input receptor of the connecting wall. The method can include installing a second adaptor of a second emblem into the first input receptor. The method can include installing a second adaptor of a second emblem into a second input receptor of the connecting wall.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
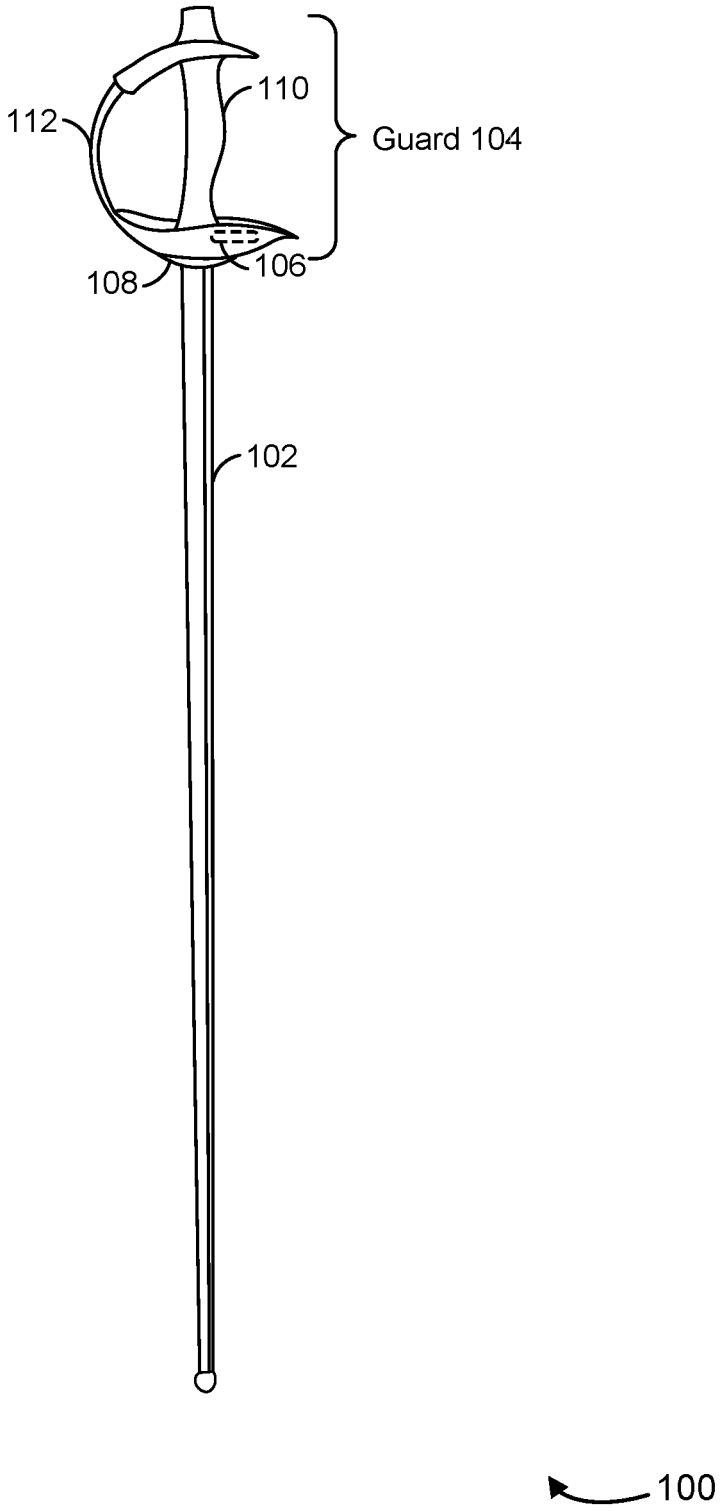
FIG. 1 is a perspective view of an example fencing sword.

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and for grinding products. The various concepts introduced above and discussed in greater detail below may be implemented in any of a number of ways, as the described concepts are not limited to any particular manner of implementation. Examples of specific implementations and applications are provided primarily for illustrative purposes.

I. Overview

Fencing swords (e.g., fencing swords, foils, epees, sabres, etc.) are used for sport, practice, recreation, and other activities. Fencing swords may be constructed using a steel material. For example, fencing swords may be made with a low-carbon steel composition that allows for flexibility and rigidity needed to compete in the sport of fencing. Steel materials may be susceptible to rust upon contact with an oxidizing agent, such as oxygen (e.g., $O_2$), in the presences of a catalyst, such as water (e.g., $H_2O$). For example, over a period of time, water (e.g., liquid water, water vapor, etc.) may catalyze a reaction between iron in steel materials and oxygen in the surrounding air. While fencing swords are created using various techniques and compositions (e.g., including various shapes and sizes), fencing swords may degrade (e.g., rust) over time and with use.

Athletes (e.g., users of fencing swords) may travel with one or more fencing swords between bouts. During use, the fencing swords may come into contact with various conditions, such as humidity, rough or hard objects, and confining space. Additionally, during use (e.g., during bouts or practice), a blade of a fencing sword may come into contact with sweat, humidity in the atmosphere, and/or other environments that may cause the blade to degrade. Due to the harmful environments, the blade may rust, acquire chips or scratches, and decrease in performance (e.g., decrease in flexibility of the blade, decrease in integrity of the blade, etc.). Further, rust may stain one or more objects that come into contact with the blade (e.g., fencing uniforms, bags, apparel, etc.).

Conventional blade covering systems may include an undesirable amount of space in-between the blade and the cover. The space may allow water vapor or other corrosive elements to surround the blade while covered by the covering systems. The covering systems may include loose affixing mechanisms, allowing the blade to move around, and potentially damaging the blade (e.g., due to an impact of the blade into a side of the covering system).

Implementations described herein provide an improved fencing sword cover system. For example, a fencing sword cover system may include a sheath that provides a close fit (e.g., a friction fit, a fit providing no air space in-between the blade and the sheath) to the blade of a fencing sword. As a result, the fencing sword cover system can mitigate rust development by substantially preventing vapor or other corrosive elements from contacting the blade while sheathed. The fencing sword cover system may include a guard cover configured to selectively couple to and/or around the fencing sword. For example, the guard cover may include one or more guard couplings that may couple around a guard of the fencing sword and/or directly to the guard of the fencing sword. Advantageously, the fencing sword cover system may be compatible with many types of fencing swords. The guard of the fencing sword cover system may include input receptors for emblems. The emblems may include figures, numbers, letters, and shapes, among other types of geometric forms. As a result, the guard of the fencing sword cover system may be stylized according to a user's preferences. Additionally, the guard of the fencing sword cover system may be removable. As a result, the fencing sword coupling system may be further customizable with various styles of guards based on user preference.

II. Overview of Fencing Sword Coupling System

Figure 2:
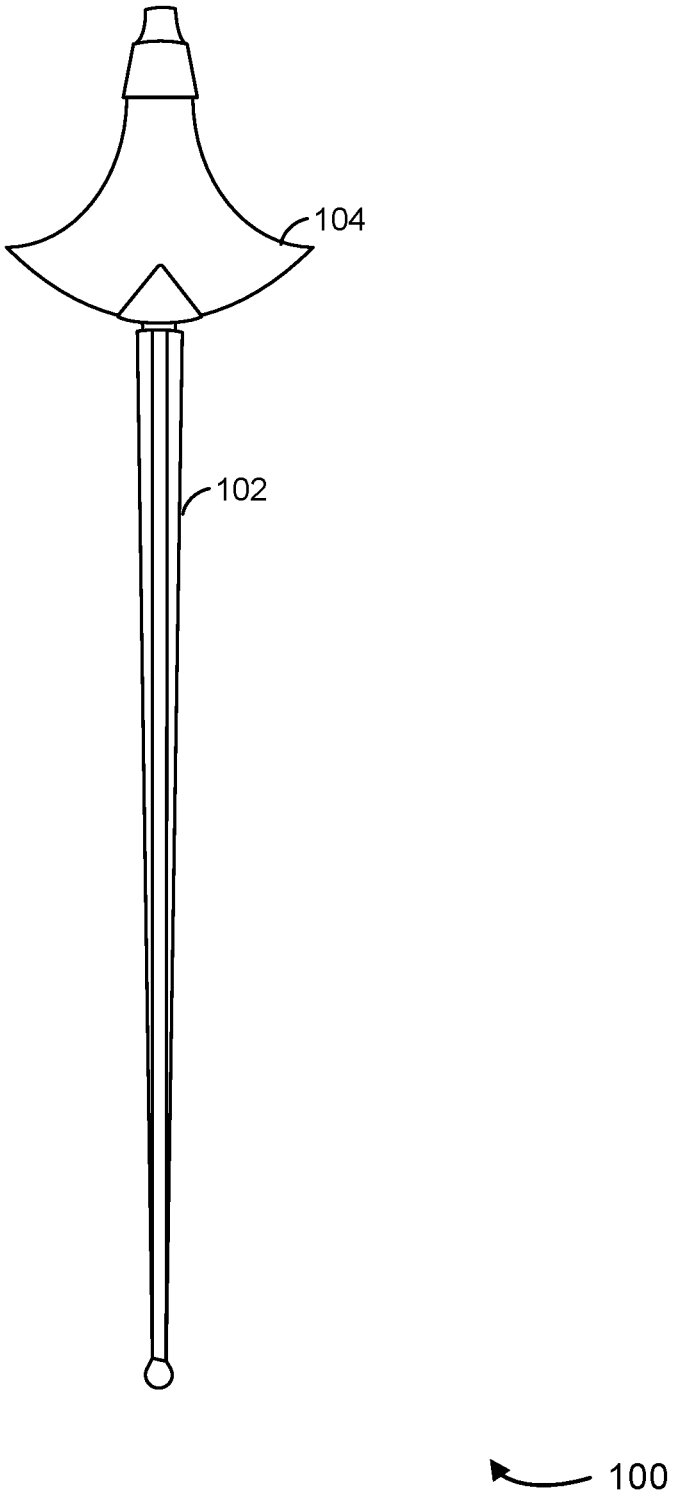
FIG. 2 is a front view of a portion of the fencing sword shown in FIG. 1.

Referring to FIGS. 1 and 2, various views of an example fencing sword 100 (e.g., epee, foil, sabre, etc.) are shown, according to an example embodiment. The fencing sword 100 includes a blade 102 and a guard 104. In some embodiments, the fencing sword 100 includes a guard clasp 106. The fencing sword 100 may include more or fewer components. In some embodiments, the fencing sword 100 may have different lengths, sizes, and compositions.

The blade 102 may have different characteristics (e.g., lengths, weight, cross-sectional shapes, etc.) depending on an intended use and the type of fencing sword. For example, an epee blade may have various lengths (e.g., from approximately 64 centimeters (cm) to 90 cm) based on an age and skill level (e.g., rank) of a user of the epee. An epee blade intended for competition may be lighter than one intended for practice and may further be based on user preference (e.g., from approximately 300 grams (g) to 770 g). The epee blade has a triangular cross-section (e.g., to house one or more wires) in which any one of the three side widths of the epee blade may be below a threshold width (e.g., below 24 millimeters (mm) for competition). The epee blade is flexible and without a cutting edge. A foil blade and a sabre blade may similarly vary in characteristics based on intended use. The foil and sabre blades have approximately rectangular cross-sections. The foil blade is flexible and without a cutting edge. The sabre blade is flexible towards an end of the blade and has a cutting edge. The blade 102 may be constructed using a steel material. During use of the fencing sword 100, the blade 102 may come into contact with air and/or water, and the blade 102 may rust. The blade 102 includes a blade base disposed at a first end of the blade 102 and a blade tip disposed at a second end of the blade 102, opposite the first end.

The guard 104 is disposed at the second end of the blade 102. In some embodiments, the blade 102 may be contiguous with the guard 104. The blade 102 extends away from the guard 104 in a first direction (e.g., such that the first end of the blade 102 is disposed away from the guard 104). A first portion 108 of the guard 104 may extend away from the base of the blade 102 in a second direction, angled with respect to the first direction. The first portion 108 of the guard 104 may be configured to be a disc shape to protect a hand of a user of the fencing sword 100. The guard 104 may include a second portion 110. The second portion 110 may include a handle sized to be held by a user. The second portion 110 may extend away from the blade 102 in a third direction, opposite the first direction. The guard 104 may include a third portion 112. The third portion 112 may be contiguous with the first and second portions 108 and 110. The third portion 112 may be configured to be a crescent shape to further protect the hand (e.g., fingers) of the user. The guard 104 may have different characteristics (e.g., shape, style, configuration, etc.) depending on the type of fencing sword and based on a preference of the user. For example, an epee guard may have a hemispherical shape (e.g., a bell guard) configured to protect a hand of the user (e.g., having a depth of 3-5.5 centimeters (cm) and a diameter at most 13.5 cm). A foil guard may be smaller than the epee guard (e.g., having less depth and a smaller diameter). A sabre guard may have a hemispherical shape that extends into a crescent shape to couple to an end of a handle of the sabre guard.

The guard clasp 106 may be located on an inside surface of the first portion 108 of the guard 104. The guard clasp 106 may include one or more clasping elements. For example, the clasping elements may be one or more receivers (e.g., a snap clasp receiver, a hook receiver, etc.). In some embodiments, the receiver may form a cavity configured to couple to a second clasping element (e.g., a pin, a dowel, a peg, etc.). In some embodiments, the receiver may be a loop configured to couple to (e.g., fasten, clasp) a carabiner via a gate of the carabiner. The clasping elements may be the insertor (e.g., the pin, the carabiner, etc.).

Figure 3:
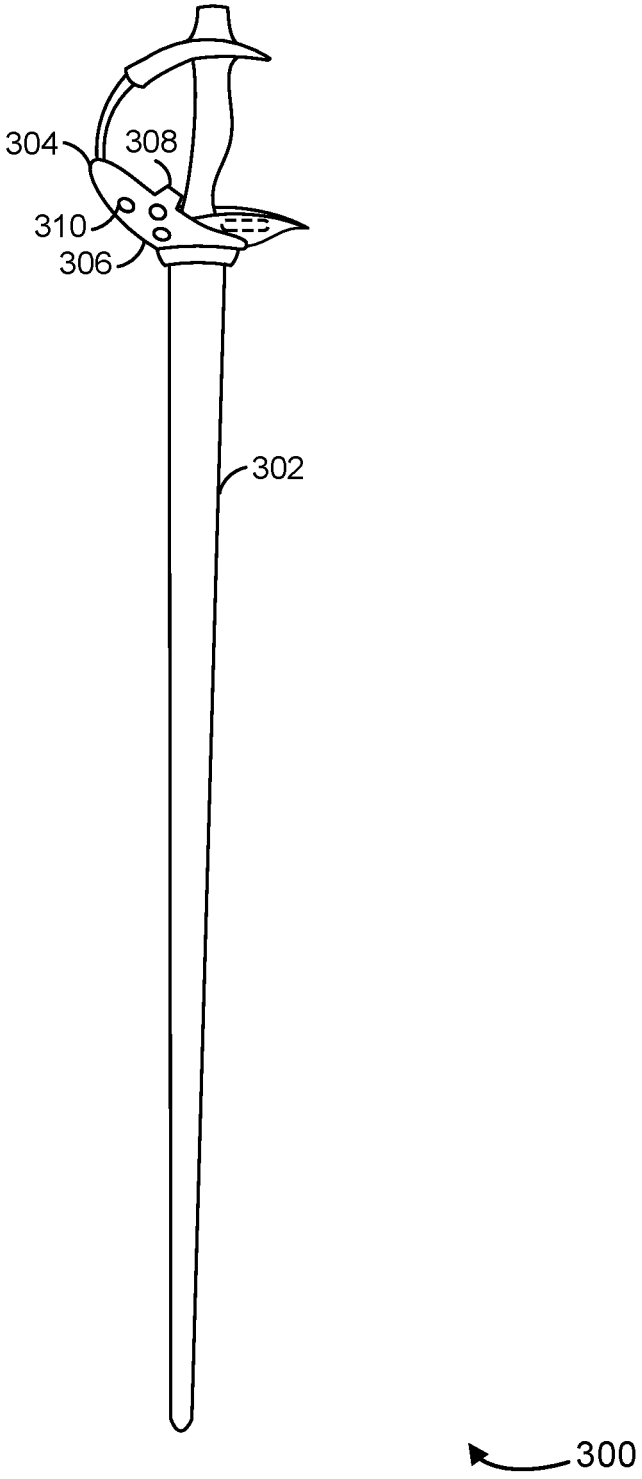
FIG. 3 is a perspective view of a fencing sword cover system covering the fencing sword shown in FIG. 1.

FIG. 3 depicts an example fencing sword cover system 300 covering the fencing sword 100. The fencing sword cover system 300 is configured to cover (e.g., surround, encase, shield, envelope, sheath, etc.) the fencing sword 100. The fencing sword cover system 300 includes a sheath 302 (e.g., a sheath subsystem, a sheath portion, etc.) and a guard cover 304 (e.g., a guard subsystem, a guard portion, etc.). It should be understood that the fencing sword cover system 300 may include more of fewer components than as shown in FIG. 3. Various aspects of the fencing sword cover system 300 are shown and described herein with respect to FIGS. 4-6.

Figure 4:
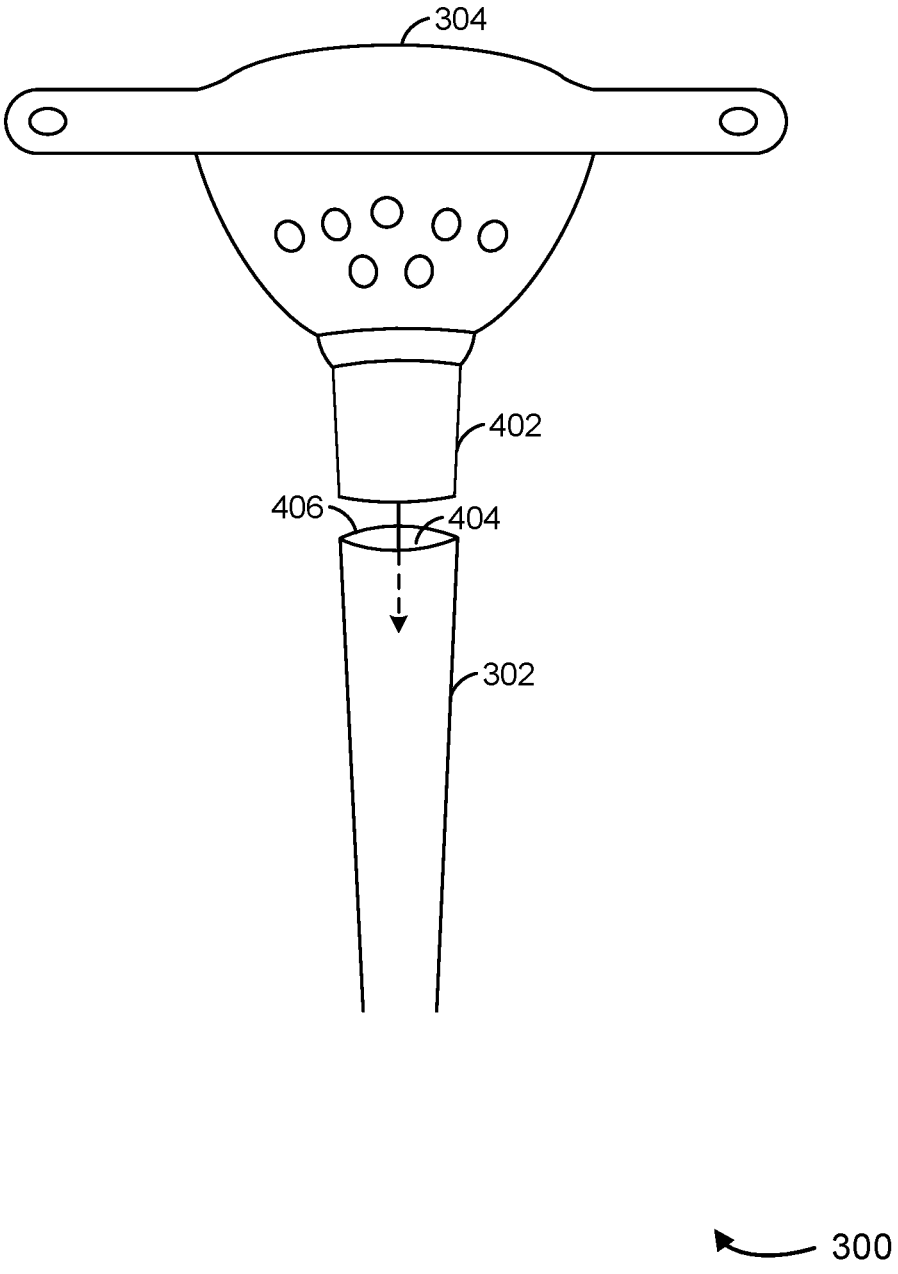
FIG. 4 is a front view of a portion of the fencing sword cover system shown in FIG. 3 with certain components separated.

Referring to FIG. 4, various aspects of the fencing sword cover system 300 are shown, according to an example embodiment. The sheath 302 is configured to cover the blade 102 of the fencing sword 100. The sheath 302 includes a sheath body 406. The sheath body 406 may be made of a pliable (e.g., elastic, stretchy, etc.) material, such as a rubber material (e.g., gum, synthetic rubber, natural rubber, etc.), a plastic or polymeric material (e.g., polystyrene, etc.), a woven or non-woven fabric material (e.g., leather, polyester, etc.), or other suitable material. The sheath 302 protects the blade 102 by mitigating damage to the blade 102 (e.g., by reducing the likelihood of physical damage, reducing the likelihood of chips or scratches, etc.) from some impacts.

The sheath body 406 has a sheath body length that is at least as long as the blade 102. For example, the sheath body 406 may be longer than the blade 102. In this way, the sheath body 406 is configured to receive the blade 102 therein (e.g., within an interior cavity 404).

The sheath body 406 may form (e.g., define) the interior cavity 404 (e.g., a void). The sheath 302 is configured to receive the fencing sword 100 in the interior cavity 404.

In some embodiments, the interior cavity 404 may be larger than the blade 102. For example, a diameter of the interior cavity 404 may be sufficiently large as to accept different types of blades 102 (e.g., different cross-sections, different lengths, etc.).

In other embodiments, the interior cavity 404 is smaller than a diameter of the blade 102. For example, the interior cavity 404 has a first diameter (e.g., an initial diameter) when the blade 102 is not sheathed. When the blade 102 is sheathed, the blade 102 contacts the sheath body 406 such that the sheath body 406 deflects away from the blade 102 (e.g., due to the flexible attributes of the material of the sheath body 406). In this way, the blade 102 causes the diameter of the interior cavity 404 to expand from the first diameter to a second diameter (e.g., during and after insertion of the blade 102). The first diameter of the interior cavity 404 is smaller than a second diameter.

In an example embodiment, when the blade 102 is not inserted in the interior cavity 404, the diameter of the interior cavity 404 may be of a first size. In operation, a user may insert the blade 102 into the interior cavity 404. During insertion, the diameter of the interior cavity 404 may increase to a second size larger than the first size (e.g., due to the force of inserting the blade 102). Due to the variable increase in size, the interior cavity 404 may be compatible with the different types of blades 102 (e.g., different cross-sectional shapes and sizes, different lengths, etc.). Additionally, the variable increase in size may result in a close fit (e.g., a friction fit) such that the sheath body 406 substantially prevents moisture from contacting the blade 102 while sheathed by the sheath 302.

The guard cover 304 is configured to at least partially cover the guard 104 of the fencing sword 100. In some embodiments, the guard cover 304 is configured to couple to the guard 104. In other embodiments, the guard cover 304 is configured to fit around the guard 104. The guard cover 304 includes a guard coupling 308, a connecting wall 306, and a sheath coupling 402. The guard cover 304 is removably coupled to the sheath 302 via the sheath coupling 402. The guard cover 304 may be made of a similar material as the sheath 302 or another material.

The guard coupling 308 is disposed at a first end of the guard cover 304. In some embodiments, the guard coupling 308 is made from a flexible material, such as a woven or non-woven fabric material, a plastic material, a rubber material, and/or other suitable material. Features of the guard coupling 308 are described in greater detail herein with respect to FIG. 5.

The connecting wall 306 extends away from the guard coupling 308 and towards the sheath coupling 402. For example, the connecting wall 306 may extend between the first end of the guard cover 304 towards a second end of the guard cover 304, opposite the first end. The guard coupling 308 is separated from the sheath coupling 402 by the connecting wall 306. The connecting wall 306 is contiguous with the sheath coupling 402. The connecting wall 306 is contiguous with the guard coupling 308.

The guard coupling 308 is disposed at the first end of the guard cover 304. The sheath coupling 402 is disposed at the second end of the guard cover 304.

The sheath coupling 402 extends away from the connecting wall 306 and towards the sheath 302. More specifically, at least a portion of the sheath coupling 402 extends into the interior cavity 404 of the sheath 302 while the guard cover 304 is coupled to the sheath 302. In this way, the sheath coupling 402 enables coupling the guard cover 304 to the sheath 302. That is, the guard cover 304 may be selectively coupled to the sheath 302 by the sheath coupling 402. In some embodiments, the sheath coupling 402 is made from a flexible material similar to the guard coupling 308 or another flexible material.

In an example embodiment, an outer diameter of the sheath coupling 402 is smaller than an inner diameter of the interior cavity 404 of the sheath 302. The sheath coupling 402 may be inserted into the interior cavity 404. The sheath coupling 402 may be coupled to the interior cavity 404 via a friction fit. In some embodiments, the sheath coupling 402 may be coupled to the interior cavity 404 via another securing method (e.g., a textured surface to increase friction, a ribbed surface to lock the sheath coupling 402 in place, etc.).

In operation, the user may insert or remove the guard cover 304 from the sheath 302 via the sheath coupling 402. For example, the user may insert the sheath coupling 402 into the interior cavity 404. The user may remove the sheath coupling 402 from the sheath 302 by exerting an opposite force from the direction of the sheath 302 (e.g., pull the sheath coupling 402 out from the interior cavity 404).

In some embodiments, the guard cover 304 may include a first set of attributes. For example, the first set of attributes may include color, shape, size, or tone, among other types of physical or visual attributes. The guard cover 304 may be interchangeable with a second guard cover 304 including a second set of attributes different from the first set of attributes. For example, the user may switch the guard cover 304 for the second guard cover 304. The user may do so by removing the guard cover 304 from the sheath 302 (via the sheath coupling 402) and inserting the second guard cover 304 into the sheath 302 (via a second sheath coupling 402 of the second guard cover 304). In this way, the user may customize the fencing sword cover system 300 based on a preference of the user. Additionally, in some embodiments, by switching the guard cover 304, different types of guard covers 304 compatible with different types of guards 104 may be used with the sheath 302. Furthermore, different types of sheaths 302 compatible with different types of blades 102 may be used with the guard cover 304.

Figure 5:
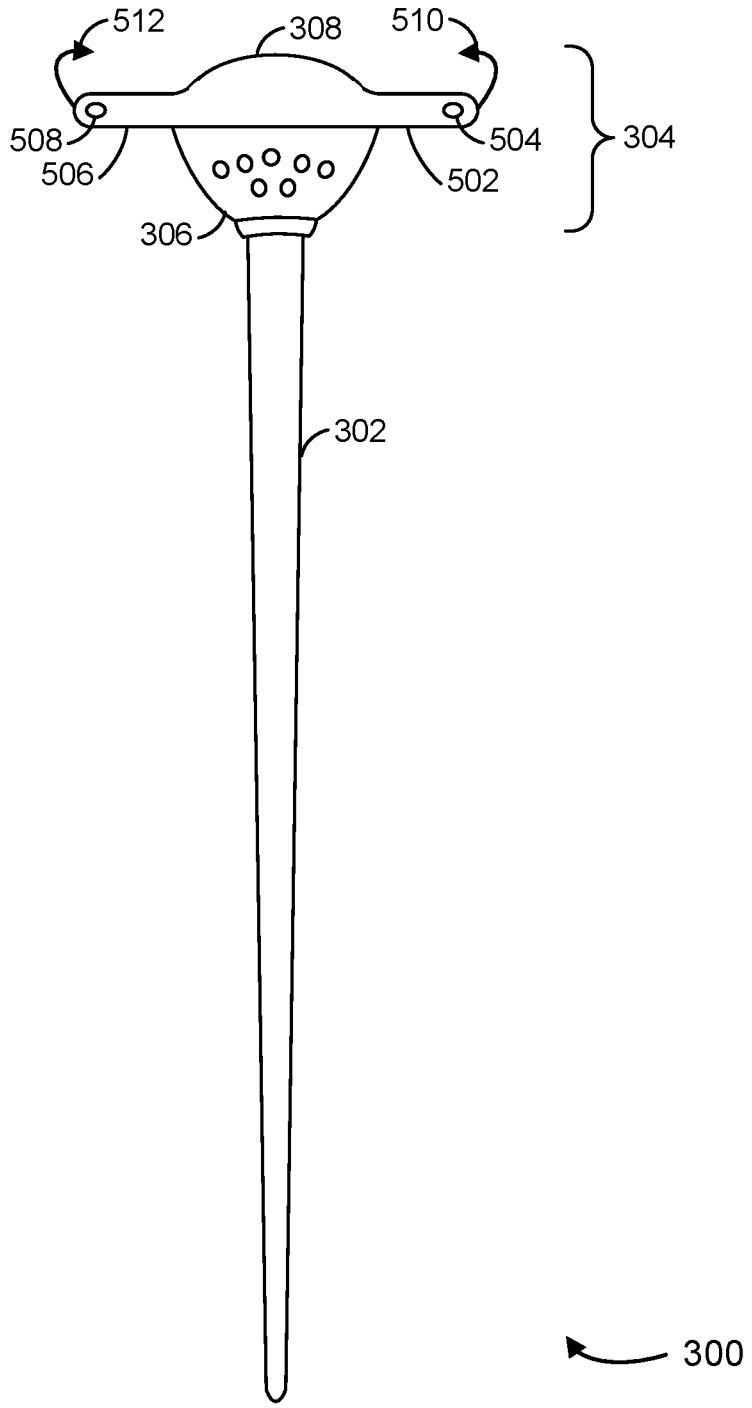
FIG. 5 is a front view of a portion of the fencing sword cover system shown in FIG. 3.

Referring to FIG. 5, various aspects of the fencing sword cover system 300 are shown, according to an example embodiment. In some embodiments, the guard coupling 308 includes a first distal portion 502 and a second distal portion 506. The first and second distal portions 502 and 506 may be straps (e.g., bands, ties, fasteners, etc.) located at opposing ends of the guard coupling 308 (e.g., across from each other). The first distal portion 502 may include a first guard clasp 504 and the second distal portion 506 may include a second guard clasp 508. The first and second guard clasps 504 and 508 may be a type of fastener, hook, latch, or other mechanism that allows for coupling the guard cover 304 to the guard 104 of the fencing sword 100.

In some embodiments, the guard coupling 308 is configured to couple the guard cover 304 to the guard 104. For example, the user may wrap the first guard clasp 504 around a portion of the guard 104 (e.g., the first portion 108, the second portion 110, or the third portion 112, as described herein with reference to FIGS. 1 and 2) from a first direction 510. The user may wrap the second guard clasp 508 around the portion of the guard 104 from a second direction 512. The user may couple the first guard clasp 504 to the second guard clasp 508 such that the guard cover 308 covers the portion of the guard 104. In some embodiments, the user may couple the first guard clasp 504 to a third guard clasp 106 of the guard 104 and the second guard clasp 508 to a fourth guard clasp 106 of the guard 104 such that the guard cover 308 covers the portion of the guard 104. In some embodiments, when the guard coupling 308 is coupled to the guard 104, the first distal portion 502 is disposed around the first portion 108 of the guard 104 and the second distal portion 506 is disposed around the first portion 108 of the guard 104. In some embodiments, when the guard coupling 308 is coupled to the guard 104, the first distal portion 502 is disposed around the third portion 112 of the guard 104 and the second distal portion 506 is disposed around the third portion 112 of the guard 104.

Figure 6:
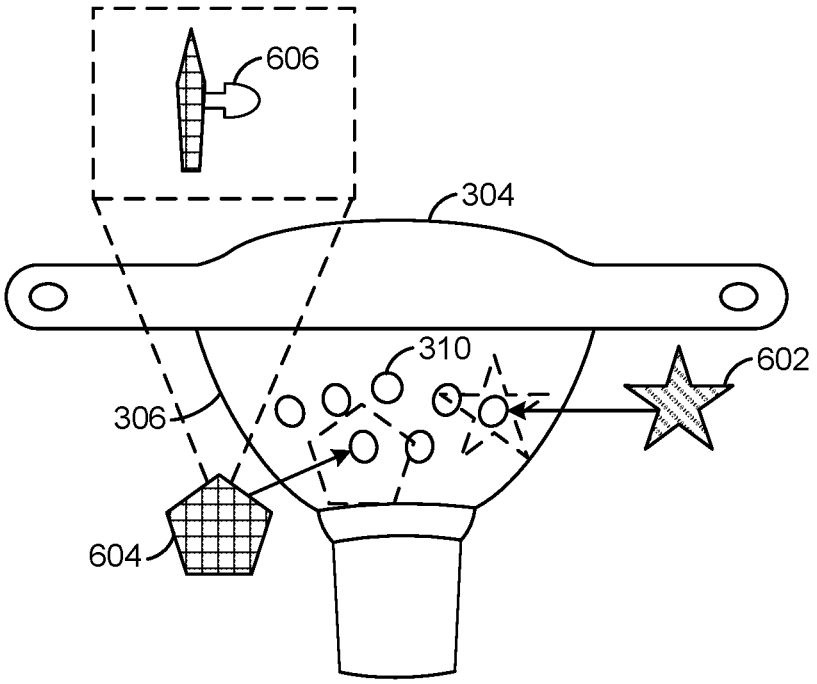
FIG. 6 is a front view of a portion of the fencing sword cover system shown in FIG. 3 with certain components added.

Referring to FIG. 6, various aspects of the fencing sword cover system 300 are shown, according to an example embodiment. The connecting wall 306 may form one or more input receptors 310 (e.g., openings, holes, etc.). The input receptors 310 may be configured to accept (e.g., receive, etc.) emblems (e.g., icons, symbols, badges, etc.). For example, the user may insert a first emblem 602 into a first input receptor 310. The user may replace the first emblem 602 with a second emblem 604. The user may remove the first emblem 602 from the first input receptor 310 and insert the second emblem 604 into the first input receptor 310. Additionally, or alternatively, the user may insert the second emblem 604 into a second input receptor 310 of the connecting wall 306.

The emblems 602 and 604 may include a adaptor 606 (e.g., a pin, a rod, a dowel, a peg, a knob, a plug, etc.) that is configured to fit into the input receptors 310. For example, the adaptor 606 may be of a bullet shape (e.g., a bullet-nose curve) with a nose (e.g., head) that is smaller in diameter than an inferior portion contiguous with the nose. The adaptor 606 may include a notch contiguous with the inferior portion that is smaller in diameter than the inferior portion. The diameter of the inferior portion being greater than the diameter of the input receptors 310. As such, the adaptor 606 may be inserted into an input receptor 310 (nose first) up to the notch. Because the inferior portion has a greater diameter than the input receptors 310, the emblems 602 and 604 may be locked into place (e.g., secured, etc.). In some embodiments, the adaptor 606 may be of a pliable material (e.g., rubber, plastic compound, etc.) such that the adaptor 606 can be collapsed (e.g., bent, squeezed, etc.) and pushed or pulled through the input receptor 310 (e.g., both via insertion and removal).

In some embodiments, the emblems 602 and 604 may include different sets of attributes. Each set of attributes may include a color, shape, size, or tone. For example, the first emblem 602 may be yellow, have a star shape, be of a first size, and exhibit a first tone (e.g., bright, happy, etc.). The second emblem 604 may have a red and white pattern, have a pentagonal shape, be of a second size greater than the first size, and exhibit a second tone (e.g., resolute, awe-inspiring, etc.). While the given examples depict a first and second set of attributes, any number of attributes may be represented by various emblems. For example, the emblems may depict one or more images, include textured surfaces, include protruding surfaces, etc. In this way, the user may customize the fencing sword cover system 300 by exchanging, adding, or removing one or more emblems from the guard cover 304 based on a preference of the user.

Figure 7:
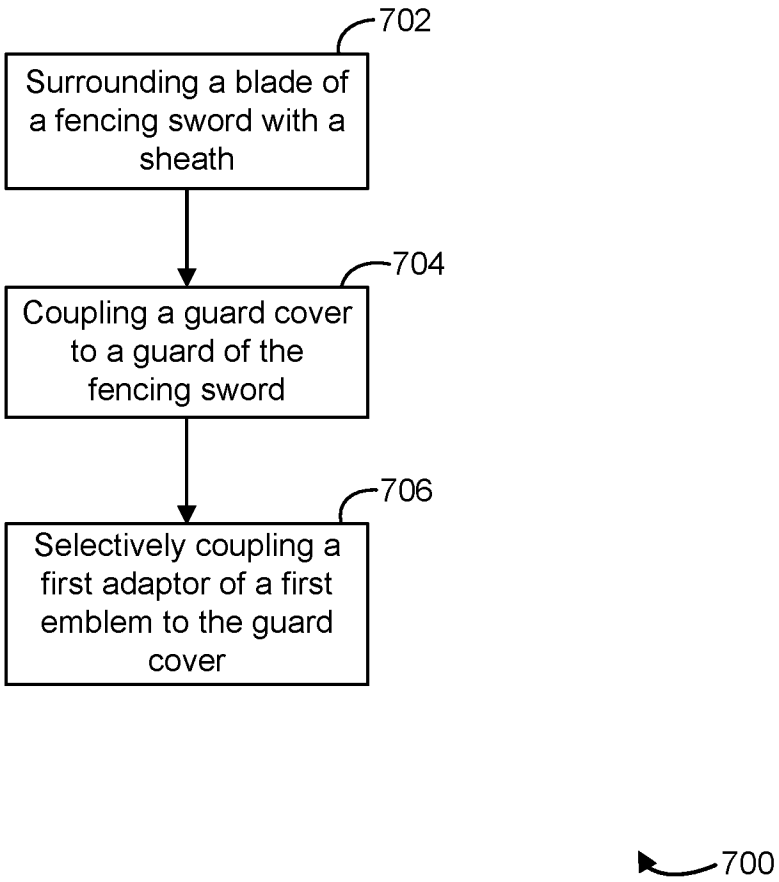
FIG. 7 is a method for covering a fencing sword by a fencing sword cover system, according to some embodiments.

FIG. 7 is a method 700 for covering a fencing sword 100 by a fencing sword cover system 300, in accordance with an implementation. The method 700 can be performed by one or more system, component, or module depicted in FIGS. 1-6. The method 700 may include more or fewer operations and the operations may be performed in any order. At operation 702, a user can surround at least a portion of a blade 102 of a fencing sword 100 with a sheath 302 of the fencing sword cover system 300.

At operation 704, the user can couple a guard cover 304 of the fencing sword cover system 300 to the fencing sword 100 by coupling a guard coupling 308 to a guard 104 of the fencing sword 100. The guard cover 304 can include a sheath coupling 402 coupled to the sheath 302, a connecting wall 306 contiguous with the sheath coupling 402, and the guard coupling 308. The connecting wall 306 can include one or more input receptors 310. The guard coupling 308 can be contiguous with the connecting wall 306 and separated from the sheath coupling 402 by the connecting wall 306.

In some embodiments, to perform operation 704, the user can couple a first guard clasp 504 disposed on a first distal portion 502 of the guard coupling 308 to a second guard clasp 508 disposed on a second distal portion 506 of the guard coupling 308, the first distal portion 502 and the second distal portion 506 disposed around the guard 104 of the fencing sword 100. In some embodiments, to perform operation 704, the user can couple a first guard clasp 504 disposed on a first distal portion 502 of the guard coupling 308 to a second guard clasp 106 of the guard 104 and couple a third guard clasp 508 disposed on a second distal portion 506 of the guard coupling 308 to a fourth guard clasp 106 of the guard 104, the first distal portion 502 and the second distal portion 506 disposed around the guard 104 of the fencing sword 100.

In some embodiments, the sheath coupling 402 can be disposed on an inferior portion of the guard cover 304 and configured to selectively couple to the sheath 302 through insertion of the sheath coupling 402 into an interior cavity 404 of the sheath 302. In some embodiments, the user can selectively couple a second guard cover 304 to the sheath 302. The user can remove the sheath coupling 402 from the interior cavity 404 of the sheath 302 and insert a second sheath coupling 402 of the second guard cover 304 into the interior cavity 404 of the sheath 302.

At operation 706, the user can selectively couple a first adaptor 606 of a first emblem 602 to the first input receptor 310. In some embodiments, the connecting wall 306 can include a second input receptor 310, where the first adaptor 606 is configured to be selectively coupled to the second input receptor 310. In some embodiments, the user can selectively couple a second adaptor 606 of a second emblem 604 to the first input receptor 310. The user can remove the first adaptor 606 from the first input receptor 310 and insert the second adaptor 606 into the first input receptor 310.

Figure 8:
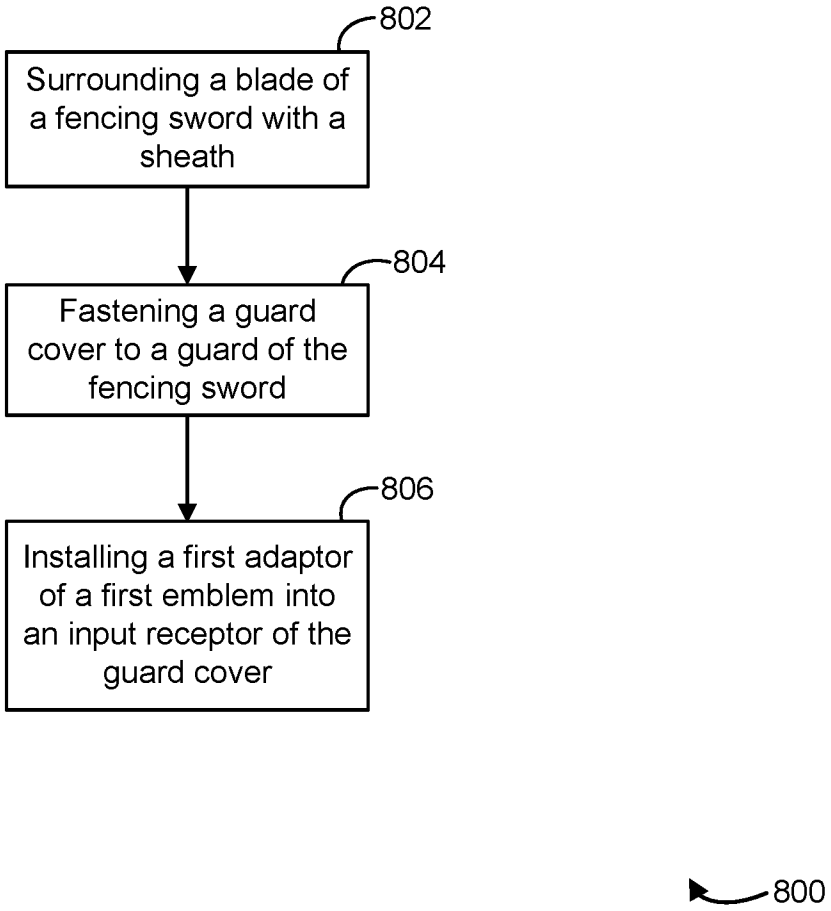
FIG. 8 is a method for covering a fencing sword by a fencing sword cover system, according to some embodiments.

FIG. 8 is a method 800 for covering a fencing sword 100 by a fencing sword cover system 300, in accordance with an implementation. The method 800 can be performed by one or more system, component, or module depicted in FIGS. 1-6. The method 800 may include more or fewer operations and the operations may be performed in any order.

At operation 802, a user can surround at least a portion of a blade 102 of a fencing sword 100 with a sheath 302. At operation 804, the user can fasten a guard cover 304 to a guard 104 of the fencing sword 100. The guard cover 304 can be selectively coupled to the sheath 302 and include a connecting wall 306. At operation 806, the user can install a first adaptor 606 of a first emblem 602 into a first input receptor 310 of the connecting wall 306.

In some embodiments, the user can remove the first adaptor 606 from the first input receptor 310. The user can install the first adaptor 606 into a second input receptor 310 of the connecting wall 306. Additionally, or alternatively, the user can install a second adaptor 606 of a second emblem 604 into the first input receptor 310. In some embodiments, the user can install a second adaptor 606 of a second emblem 604 into a second input receptor 310 of the connecting wall 306. The first emblem 602 may include a first set of attributes and the second emblem 604 may include a second set of attributes. The first and second sets including at least one of color, shape, size, or tone.

III. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some embodiments, be excised from the combination, and the claimed combination may be directed to a subcombination or variation of a subcombination.

As utilized herein, the terms "substantially," "generally," "approximately," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W to P, etc.) herein are inclusive of their maximum values and minimum values (e.g., W to P includes W and includes P, etc.), unless otherwise indicated. Furthermore, a range of values (e.g., W to P, etc.) does not necessarily require the inclusion of intermediate values within the range of values (e.g., W to P can include only W and P, etc.), unless otherwise indicated.

What is claimed is:

1. A fencing sword cover system comprising:
- a sheath configured to surround at least a portion of a blade of a fencing sword;
- a guard cover comprising:
  - a sheath coupling coupled to the sheath,
  - a connecting wall contiguous with the sheath coupling, the connecting wall comprising a first input receptor, and
  - a guard coupling coupled to a guard of the fencing sword, the guard coupling contiguous with the connecting wall and separated from the sheath coupling by the connecting wall; and
  - a first emblem comprising a first adaptor, the first adaptor configured to be selectively coupled to the first input receptor.

2. The fencing sword cover system of claim 1, wherein the guard coupling comprises:
- a first guard clasp disposed on a first distal portion of the guard coupling and a second guard clasp disposed on a second distal portion of the guard coupling, the guard coupling configured to couple the guard cover to the guard of the fencing sword by coupling the first guard clasp to the second guard clasp, the first distal portion and the second distal portion disposed around the guard of the fencing sword.

3. The fencing sword cover system of claim 1, wherein the guard coupling comprises:
- a first guard clasp disposed on a first distal portion of the guard coupling and a second guard clasp disposed on a second distal portion of the guard coupling, the guard coupling further configured to couple the guard cover to the guard of the fencing sword by coupling the first guard clasp to a third guard clasp of the guard and coupling the second guard clasp to a fourth guard clasp of the guard, the first distal portion and the second distal portion disposed around the guard.

4. The fencing sword cover system of claim 1, wherein the sheath coupling is disposed on an inferior portion of the guard cover and configured to selectively couple to the sheath through insertion of the sheath coupling into an interior cavity of the sheath.

5. The fencing sword cover system of claim 4, further comprising:

a second guard cover configured to selectively couple to the sheath through: removal of the sheath coupling from the interior cavity of the sheath and insertion of a second sheath coupling of the second guard cover into the interior cavity of the sheath.

6. The fencing sword cover system of claim 1, wherein:

the connecting wall comprises a second input receptor; and the first adaptor is configured to be selectively coupled to the second input receptor.

7. The fencing sword cover system of claim 1, further comprising:

a second emblem comprising a second adaptor, the second adaptor configured to be selectively coupled to the first input receptor through removal of the first adaptor from the first input receptor, and insertion of the second adaptor into the first input receptor.

8. A method for covering a fencing sword by a fencing sword cover system, the method comprising:

surrounding at least a portion of a blade of the fencing sword with a sheath of the fencing sword cover system; and coupling a guard cover of the fencing sword cover system to the fencing sword by coupling a guard coupling to a guard of the fencing sword, the guard cover comprising:

a sheath coupling coupled to the sheath, a connecting wall contiguous with the sheath coupling, the connecting wall comprising a first input receptor, and the guard coupling, the guard coupling contiguous with the connecting wall and separated from the sheath coupling by the connecting wall; and selectively coupling a first adaptor of a first emblem to the first input receptor.

9. The method of claim 8, wherein coupling the guard coupling to the guard further comprises:

coupling a first guard clasp disposed on a first distal portion of the guard coupling to a second guard clasp disposed on a second distal portion of the guard coupling, the first distal portion and the second distal portion disposed around the guard of the fencing sword.

10. The method of claim 8, wherein coupling the guard coupling to the guard further comprises:

coupling a first guard clasp disposed on a first distal portion of the guard coupling to a second guard clasp of the guard; and coupling a third guard clasp disposed on a second distal portion of the guard coupling to a fourth guard clasp of the guard, the first distal portion and the second distal portion disposed around the guard of the fencing sword.

11. The method of claim 8, wherein the sheath coupling is disposed on an inferior portion of the guard cover and configured to selectively couple to the sheath through insertion of the sheath coupling into an interior cavity of the sheath.

12. The method of claim 11, further comprising:

selectively coupling a second guard cover to the sheath by:

removing the sheath coupling from the interior cavity of the sheath; and inserting a second sheath coupling of the second guard cover into the interior cavity of the sheath.

13. The method of claim 8, wherein:

the connecting wall comprises a second input receptor; and the first adaptor is configured to be selectively coupled to the second input receptor.

14. The method of claim 8, further comprising:

selectively coupling a second adaptor of a second emblem to the first input receptor by:

removing the first adaptor from the first input receptor; and inserting the second adaptor into the first input receptor.

15. A method comprising:

surrounding at least a portion of a blade of a fencing sword with a sheath;

fastening a guard cover to a guard of the fencing sword, the guard cover selectively coupled to the sheath and comprising a connecting wall; and installing a first adaptor of a first emblem into a first input receptor of the connecting wall.

16. The method of claim 15, further comprising:

removing the first adaptor from the first input receptor; and installing the first adaptor into a second input receptor of the connecting wall.

17. The method of claim 15, further comprising:

removing the first adaptor from the first input receptor; and installing a second adaptor of a second emblem into the first input receptor.

18. The method of claim 15, further comprising:

installing a second adaptor of a second emblem into a second input receptor of the connecting wall.

19. The method of claim 18, wherein the first emblem comprises a first set of attributes and the second emblem comprises a second set of attributes different from the first set of attributes.

20. The method of claim 19, wherein the first set of attributes and the second set of attributes comprise at least one of color, shape, size, or tone.

* * * * *